US005177929A

United States Patent [19]

Reynolds

[11] Patent Number: 5,177,929

[45] Date of Patent: Jan. 12, 1993

[54] CEILING DEVICES AND METHODS OF INSTALLING SAME

[76] Inventor: Henry B. Reynolds, 5615 McLean Dr., Bethesda, Md. 20814

[21] Appl. No.: 786,600

[22] Filed: Nov. 1, 1991

[51] Int. Cl.[5] ..... E04B 1/00

[52] U.S. Cl. ..... 52/745.05; 52/484; 52/486

[58] Field of Search ..... 52/741, 484, 486, 488

[56] References Cited

U.S. PATENT DOCUMENTS

| | | | |
|---|---|---|---|
| 3,767,008 | 10/1973 | LeBlanc | 52/741 X |
| 3,775,929 | 12/1973 | Roodvoets | 52/747 |
| 3,977,144 | 8/1976 | Jahn | 52/741 X |
| 4,275,541 | 6/1981 | Orals | 52/741 X |
| 4,991,370 | 2/1991 | Gailey | 52/484 |

FOREIGN PATENT DOCUMENTS

| | | | |
|---|---|---|---|
| 576180 | 5/1959 | Canada | 52/484 |

*Primary Examiner*—Richard E. Chilcot, Jr.
*Assistant Examiner*—Beth A. Aubrey
*Attorney, Agent, or Firm*—William G. Rhines

[57] ABSTRACT

This invention relates to devices and methods for installing ceilings made from tiles that are supported by a suspension grid that is not visible from the underside of the ceiling. One embodiment comprises channels that form the suspension grid, channel wall supports for supporting the grid where the ceiling abuts the walls, and hangers that are capable of establishing the ceiling level as well as supporting the suspension grid in its mid-span regions. Another embodiment comprises a method of installing the wall hangers, suspension grid channels, and hangers.

2 Claims, 2 Drawing Sheets

CEILING DEVICES AND METHODS OF INSTALLING SAME

BACKGROUND OF INVENTION

In the field of building construction, it is a common practice to install hung ceilings in new or existing structures. Various alternative structural systems and methods are used for hanging a support frame at the approximate level of the desired ceiling and then affixing tiles, panels or the like to the support frame. Such frames typically are formed from channels which, in cross section, are in the shape of a "T", an "I", or other known per se shape. They may be made from aluminum, steel, plastic or other materials that are suitable for the intended use. The tiles, panels and other surfacing materials commonly are made from cellulose, plastic, glass, and other appropriate materials.

Many such ceiling systems are known and in common use. However, many have shortcomings and difficulties that make them difficult to install, unattractive, or otherwise unacceptable in varying degrees. For example, an objection to many such systems is that they are not adapted to conceal the support frame members. In some, a resulting display of the geometric configuration of the support frame unacceptably compromises the aesthetics of the other ceiling constituents and of the ceiling as a whole. It is often difficult, or at least requires special steps, to level the support frame throughout its span to the extent necessary to produce a ceiling that is flat and planar, and is otherwise satisfactory functionally and in appearance. The source of this particular difficulty lies in the virtual impossibility of constructing the relatively heavy and large dimensioned frame of a building so that the bottom surfaces of the joist form a flat plane. The importance of this is that it is the under surfaces of these joist (which are referred to herein as "ceiling joist", although, typically they also serve as the floor joist for the floor next above) which form the base to which the ceiling is anchored. This problem has been addressed in a variety of ways. One is to attach narrow strips of wood, called "furring strips", to the underside of the ceiling joist at substantially right angles to the long direction of the joist. The effect of this is to average out undulations and other discontinuity in and as between the bottom surfaces of the floor joist collectively. However, frequently even this isn't sufficient, and shims and/or other adjustments means are resorted to in order to bring the support grid into an acceptable degree of parallelism. In the alternative, hanger wires, or threaded mounts, or pulley-like devices, or multi-holed straps or other such means are sometimes resorted to, particularly where a hung ceiling tile grid is being installed, in order to achieve the desired results.

In connection with the foregoing, reference is made to the following U.S. Pat. Nos. 4,696,141, 4,760,671, 4,089,146, 4,169,340, 3,841,048, 3,942,561, 3,863,413, 3,988,871, 3,983,116, 3,995,823, 3,998,020, 3,798,419, 3,640,042, 3,708,941, 3,714,753, 3,742,674, 2,994,112, 2,996,765, 3,004,644, 3,093,548, 3,070,851, 3,344,465, 2,406,771, 1,578,964, 2,101,952, 2,389,171, 2,725,127, and 2,963,751.

Accordingly, it is an object of this invention to provide means for installing ceiling materials.

It is a further object to provide means for achieving the foregoing purpose by which a support structure may be perfected that is concealed.

A further object is to provide means for achieving the foregoing objectives in which the need is eliminated for adjustable supports, shims, furring strips, moveable hangers, and other distance modifiers for causing the support frame to be positioned in a flat planar orientation.

Still another object of this invention is to provide means for achieving the foregoing objectives wherein the support means includes means for establishing the planar position of the ceiling system.

SUMMARY OF THE INVENTION

Embodiments of this invention comprise a ceiling made from tiles that are supported by a suspension grid wherein the grid is concealed within the edges of the tiles where they abut the walls and each other. The grid is supported on the walls by means of concealed wall brackets into which the outermost grid channels may be affixed or simply by outer channels affixed to the wall by means of screws, nails or other fastening means through holes in the channels. In mid-span, it is supported by hangers that are adapted to extend downward a predetermined distance from the associated support structure of the building in which the ceiling is located and to have the mid-span sections of the support grid channels affixed thereto. As such, the channels describe a flat plane.

Other embodiments include methods for installing a ceiling wherein either wall channel brackets are placed in position and wall channels are then affixed to the brackets or channels having holes in their back wall are affixed directly to the supporting wall by means of screws, nails or other fastening means. Hangers are positioned on the building support frame after the hangers have been formed as may be necessary to provide support for the grid from the support frame while positioning it in desired flat planar configuration. The ceiling tiles are then positioned in supported relationship with the grid and wall channels, with the channels concealed within the edges of the tiles.

DESCRIPTION OF DRAWINGS

This invention may be understood from the description which follows and from the accompanying drawings in which.

DESCRIPTION OF PREFERRED EMBODIMENTS

Figure 1:
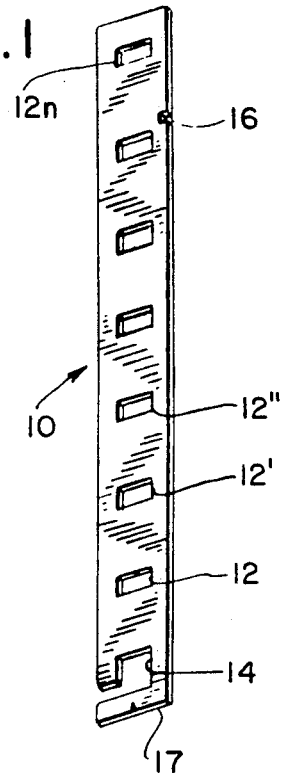
FIG. 1 is a perspective view of a hanger structure useful in practicing the present invention.
Figure 2A:
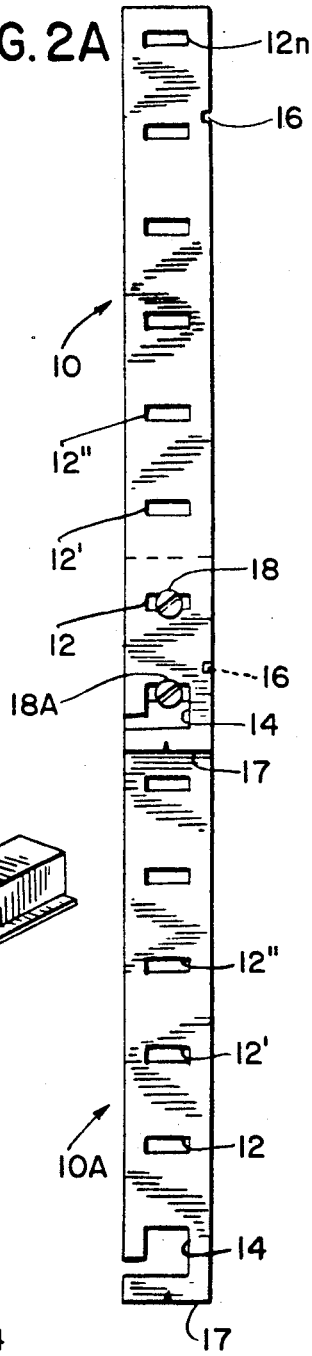
FIGS. 2A and 2B are plan views of other embodiments of structures as shown in FIG. 1.
Figure 2B:
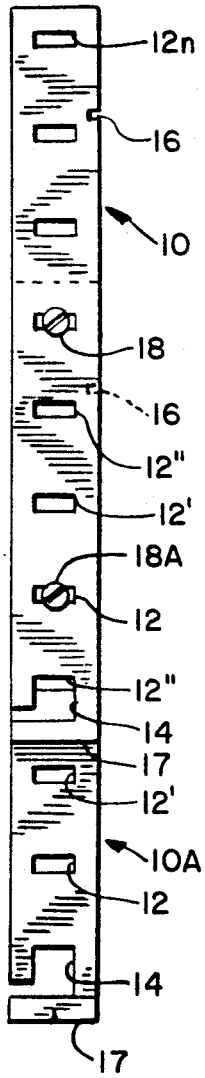
Figure 6:
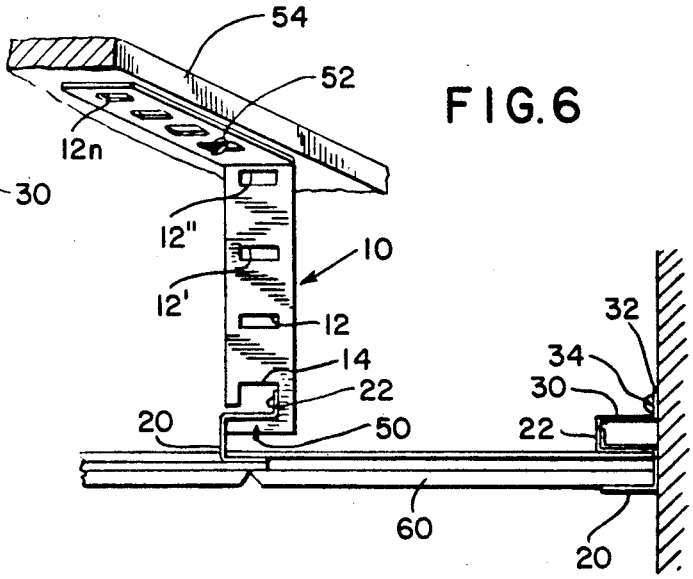
FIG. 6 is a perspective view of an embodiment of this invention.

Referring first to FIG. 1, there is depicted a leveling hanger 10 useful in practicing the present invention. As such, it is made from aluminum, steel, plastic or other suitable material, preferably by having been stamped from base stock in strip form. It includes a series of fastener holes 12, 12', 12'' . . . 12*n*, through which nails, screws, or other known per se fasteners may be inserted in order to provide means for attaching the hanger as hereinafter described. It also includes a channel mount aperture 14 and an optional ceiling level slot 16. The purposes of these will be apparent from the description which follows. The optional slot 16 as shown is positioned 1⅛ inches from the nearest end of the hanger 10. This distance is in anticipation of using wall hangers as shown in FIG. 6 in connection with a ceiling support grid that is to support ceiling tiles that are ½ inch thick, whose final position is to be such that their lower or finish surfaces are to be 1⅜ inches below the under surface of the already existing ceiling, or underside of the ceiling joist, (as the case may be) to which the ceiling is to be juxtaposed. Although the hangers 10 are desirably formed of a more or less uniform length, such as about 9 inches overall, it will be seen from FIGS. 2A and 2B that the multiplicity of fastener holes in each such hanger, in addition to their other functions, may be used to extend the effective length of a hanger assembly to give it a length greater than that of a single such hanger alone. Thus, as is depicted in each of these illustrations, a hanger member 10 is fastened to a second hanger member 10A by fastening means, such as sheet metal screws or nuts and bolts 18, 18A that are positioned in the fastener holes in both. As will be seen from comparing FIG. 2A with FIG. 2B, the total length of the resulting structure may thereby be easily regulated by simply adjusting the amount of overlap of the two hangers members in each case.

Figure 3:
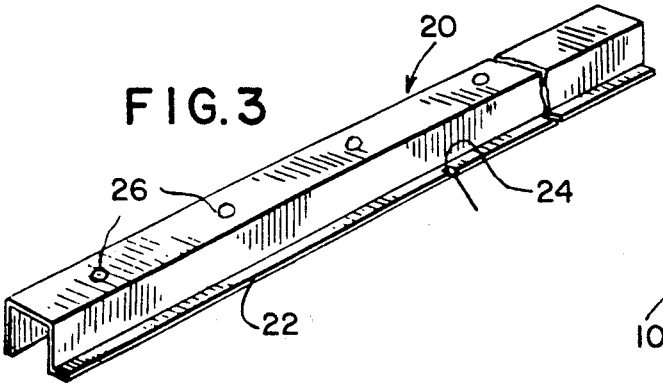
FIG. 3 is a perspective view of a channel structure useful in practicing the present invention.

FIG. 3 illustrates a channel 20 that may be used with embodiments of this invention. It may be formed from material, such as metal or plastic, which is the same as, or is compatible with the materials from which the hangers 10 and the wall hangers 30 are made. It will be noted that the channels 20, which typically may be about 8 feet in length, include a portion which is U-shaped in cross section, with a lip 22 extending along the length of the edge of one of the legs of the "U", and that the lip includes string line notches 24. The latter are advantageously placed at 1 foot intervals along the length of the lip 22, beginning 6 inches from the end of a given channel. By this means, a notch that would otherwise be positioned at each end of the channel, will be spaced from the end by one half the distance between those that are in mid-span. The purposes for having the lip and the notches, and for the spacing of the latter, will be apparent from the descriptions which follow. It should also be noted that the channels 20 may optionally or alternatively include holes 26 spaced along the back wall of the channel. By this means, wall hangers such as those shown in FIG. 4 need not be used, since the outside perimeter channels in a given system may thereby be fastened directly to the walls which support them by means of nails, screws, or other fastening means. Further, by that means, optional ceiling level slots of the type shown as 16 in FIG. 1 need not be used or present since, as will be apparent from the descriptions which follow, the plane of the underside of the hung ceiling to be newly installed may be established by alternative means.

Figure 4:
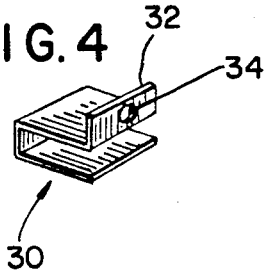
FIG. 4 is a perspective view of a wall hanger structure useful in practicing the present invention.

FIG. 4 illustrates a wall hanger structure that may be used in embodiments of this invention. It shows a wall molding hanger 30, which may be formed from materials which are the same as, or compatible with, those of the hangers 10 and/or the channels 20. As shown, they also include a portion which is substantially U-shaped in cross section with an edge lip 32 in which is positioned a mounting hole 34. Again, the purposes of these structural features will be apparent from the descriptions which follow.

It is to be understood that the various tasks of fastening as described may be carried out using standard, known per se fastening means that are appropriate for each intended use. Thus, fastening to an existing plasterboard ceiling and/or walls may be by means of so-called "toggle bolts", which are installed by drilling a hole in the surface to which attachment is to be made. The bolt is inserted into the hole, and the mounting screw is then turned. This causes the threaded portion to be drawn toward the screw head and the bolt cartridge to collapse, locking the assembly to the plasterboard. Thereafter, the bolt may be removed and the bolt remounted to secure objects to the structure beneath by engaging the bolt into the threads of the assembly. Wood screws may also be used. If they are, it is advantageous to align them with underlying studs or joists where softer materials intervene, such as plasterboard walls or ceilings. In some installations, however, such as over existing wood paneling, such screws may be used directly without special regard to the corresponding position of the studs or joists. Nails, including plasterboard nails, screw nails, or other such appropriate devices, may also be used. If masonry is the underlying material, it may be drilled and have plastic or lead anchors inserted into the drill holes to receive screws, nails or other appropriate fastening devices.

To illustrate embodiments of this invention, an example will be used in which the ceiling finishing material is in the form of square ceiling tiles. Obviously, however, the general approach that will be described is readily adaptable to situations where the ceiling material is in some other basic shape, such as rectangles. Further, the installation site may be different from or less regular than the square or rectangular room that will be described in the following example. It will also usually desired to have the tiles evenly spaced; i.e., with any rows less wide than a full tile width reduced to the same width in opposite outer rows, so that the outermost (or "border") tiles that are adjacent to opposite walls are of the same width. Of course, some other configuration of tiles may also be used where so desired.

Installation of a ceiling embodying the present invention may include the following steps: (1) "squaring" the room in preparation for installing the ceiling, (2) fastening wall molding hangers in place, (3) fastening channels to the wall molding hangers, (4) preparing for and installing hangers, (5) installing channels on the hangers, and (6) finishing the ceiling.

(1) Squaring the room

It is generally preferred, for reasons of symmetry and other aesthetic considerations, that all rows of tiles comprising a ceiling should be of the same width. If that isn't possible geometrically, at least the border rows on opposite walls may be made to have the same width. It is also usually preferred for every border row to be 6 inches or more in width to have the best appearance. To plan the desired configuration for the tiles, and therefore the positioning of the associated hardware, the walls are first designated as (1) the "starting wall", i.e., the wall adjacent to the first border row of tiles to be installed, (2) the "finishing wall", i.e., the wall adjacent to the last border row of tiles to be installed, (3) the left sidewall, i.e., the wall that is to the left when facing the starting wall, and (4) the right sidewall, i.e., the wall that is to the right when facing the starting wall. The usual and preferred orientation of the ceiling joist vis-a-vis the walls so designated, particularly where such joists (rather than an existing ceiling, for example) are to be utilized as the primary support for the hangers 10, is for the left and right sidewalls to be so selected that the ceiling joist are substantially parallel to them. In carrying out an embodiment of this invention, first the distance from the starting wall to the finishing wall is measured. If the distance so measured is such that a whole number of tiles will not fit across that dimension, either (a) add the width of a single tile to the overage if the overage less than one-half the width of a single tile, or (b) subtract the width of a single tile if the overage is greater than the width of a single tile. In either case, (c) divide the difference between the wall to wall distance and the cumulative width of the whole number of tiles to be utilized resulting from (a) or (b) above, (as the case may be), by 2. The result of that calculation will determine the distance from each of the starting and finishing walls of the abutment between the border row of (partial width) tiles and the row of (full width) tiles next adjacent to it. It will also establish the layout of the tile rows which border the sidewalls if the distance between the sidewalls is the same as that between the starting and the finishing walls: otherwise the same procedure may be followed to establish the width of the border rows adjacent to the sidewalls.

(2) Fastening wall molding hangers in place

Figure 5:
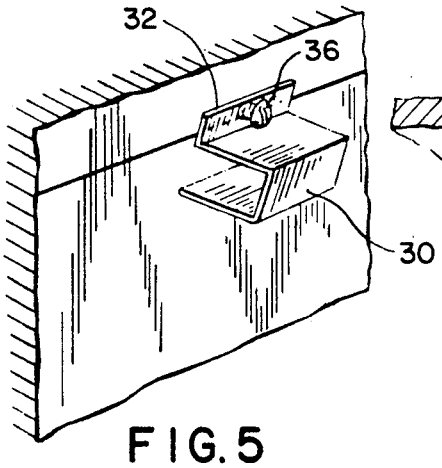
FIG. 5 is a perspective view of a wall hanger being positioned in connection with an embodiment of the present invention.

First, the desired level for the ceiling to be installed is determined and marked on the walls at each corner of the room. The existing ceiling level may not be level for a variety of reasons: e.g., the floor has settled with respect to the existing ceiling or ceiling joist, or has otherwise arrived at an uneven distance from it. If it is desired to correct for that condition in the new, hung ceiling, rather than using equal distances from the ceiling-walls-corner intercepts, those measurements may be adjusted from one to the next so as to cause the finished ceiling to be in the desired orientation and level vis-a-vis the other structural elements of the room, and the points so determined marked on the walls. With the hanger held vertical, the ceiling level slot 16 on a hanger 10 is positioned at the marks on the wall at each corner. A second, mark is made at each such corner at the end of the hanger nearest the slot 16. In a hanger as described above, that second mark in each case will be 1⅛ inches above the first mark. A chalk line is then snapped on each wall between each pair of secondary marks, so that each end of each such chalk line joins the end of a successive chalk line mark. The result is a continuum of chalk line marks around the entire room that is at a fixed distance (in this example, 1⅛ inches) above the level desired for the new ceiling. A location along each such chalk line is identified that is near, and preferably not more than 2 feet from, a corner, and is over a wall stud, if such studs are to serve as the primary support into which affixing fasteners are to be driven. Pilot holes, typically ⅛ inch in diameter, are drilled at reasonable intervals along each chalk line, such as about 4 feet. At each of these locations, as is shown in FIG. 5, a wall molding hanger 30 is loosely affixed to the wall by means of a screw 36 or other suitable fastening device. After the edge channels have been installed, as hereinafter described, the fasteners which hold the hangers 30 in place may be tightened down, thereby fitting the edge channels snugly against their associated wall surfaces. Alternatively, using channel with holes 26 arrayed along its back wall as shown in FIG. 3, such a channel may be affixed direxly to the wall by using screws or other known per se fastening devices. This arrangement is shown in greater detail in FIG. 6A.

(3) Fastening channels to the wall molding hangers

As will presently be seen, the string line notches 24 in the channels 20, after the channels are fastened to the wall hangers 30, are to serve as references from which level strings are to be run. Before such channels are fastened, the string line notches 24 of each should be aligned with the corresponding notches in the channel in the opposite wall of the room. The border tiles at each corner should be of such dimensions as to cause each of its inner edges (i.e., those not residing in the channels in which such tiles are retained) to align with the abutment lines between the border rows and the rows of full dimension tiles next adjacent to them. To achieve that, a length of channel is cut off at such a point that a string line notch 22 is the same distance from the end of the channel as the width of the border row of tiles that is to reside at right angles to the channel at that location, plus the distance by which any tongue in the edge of each tile extends beyond the edge of the finished surface of the tile. Thus, if the border tile width at that point, calculated as hereinbefore described, is 9½ inches, the first string line holes in the channels should be 9½ inches from the channel ends. But if full dimension tiles are to be used for the border tiles at that point, the string line notches should be 12 inches from the channel ends. Similar adjustments are made around the room, with full length channels 20 between the end channel pieces, so that each inner string line notch 22 is on a 12 inch center from each inner string line notch next adjacent to it. The channels 20 so prepared are then inserted into the hangers 30 with the lip 22 of each channel 20 facing upward, and are so positioned as to abut the inside of one or more hangers 30. This is illustrated on the right side of FIGS. 6 and 7, after the support fasteners 34 have been tightened down so as to hold each hanger 30 snug against its associated wall. At outside corners, the channel ends may be mitered in order to impart a finished appearance to them. At inside corners, they need not be mitered but, instead, the end of one may simply abut the side of the other. If the room is irregular in plan view, its various jogs and intrusions may be accommodated by forming inside or outside corners which also may be correspondingly mitered or abutted. When this phase of the operation is completed, a continuum of channels will extend all around the room, with their U-shaped portions occupying the same plane.

(4) Preparing for and installing channels

A string, preferably made from nylon so that it will withstand high tension, is knotted at one end, and placed through the string line notch on the left side wall that is nearest to the starting wall, with the knot and string end residing inside the channel. The string is then stretched across the room. It will therefore be across the line of ceiling joist in the situation as described. It is then fed through the corresponding first string line notch in the channel on the right side wall, run inside the channel, and then brought back out into the room through the second string line notch in the same channel. Following that, a hammer or other heavy object may be tied to the end of the string. The effect of this is to keep the string taut and substantially flat across the width of the room from one side wall to the other. If the side walls are so widely separated that the string sags, the sag may be eliminated by setting a mid-span hanger to act as a temporary support to level the string. The taut string so positioned provides a reference for establishing a flat plane for the finished ceiling by accurately positioning each hanger as hereinafter described. One by one, hangers 10 are oriented vertically so that the channel mount aperture 14 in each is oriented upward. With the hanger at right angles to the axis of the string and spaced from one of the side walls at a desired location along the string, the end 17 of the hanger 10 next adjacent to the channel mount aperture 14 is held so that it just touches the surface to which the hanger is to be attached, such as the underside of a cross-oriented ceiling joist, or an existing ceiling, or the side surface of a floor joist. No hanger should be overly distant (typically, not more than 4 feet) from each next adjacent hanger location along the length of the string, to ensure better level throughout. The location of the string along the length of the hanger is then marked, as by the positioning of a thumb. In instances where the hanger is to be suspended from the bottom of a joist, using pliers or other appropriate means, the hanger is bent as shown in FIG. 6 to form a right angle in the direction of the string at the position of the place so marked. Of course, this bending operation is not necessary in instances where the hanger, when finally positioned, is to be affixed to the side of a joist. For reasons which will be apparent presently, the orientation of the opening to the channel mount aperture 14 during this operation and when the hanger is finally positioned should be facing away from the starting wall. The hanger may then be inverted, so that its channel mount aperture 14 is at its lowermost end. As shown in FIG. 6 for the case of a bent hanger, its right-angled portion will then be adjacent to and may be affixed to the existing ceiling, the underside of the ceiling joist, or other intended support surface 54. Of course, where it is intended to support the hanger from the side of a joist, the unbent hanger may simply be so oriented and affixed. In either case, the fixation may be by means of nails, screws or other appropriate fastening means 52. The bottom end of each hanger so affixed will then be exactly at the level of the reference string 50, as is also shown in FIG. 6. That level is slightly above, but is uniformly distant from, the upper side of the ceiling tiles. This operation may then be repeated along the length of the string to complete one row of hanger supports. Thereafter, the string may be moved to placement within successive pairs of string notches and the foregoing steps repeated until the entire desired array of hanger supports has been established and fixed in place.

(5) Installing channels on the hangers

Figure 7:
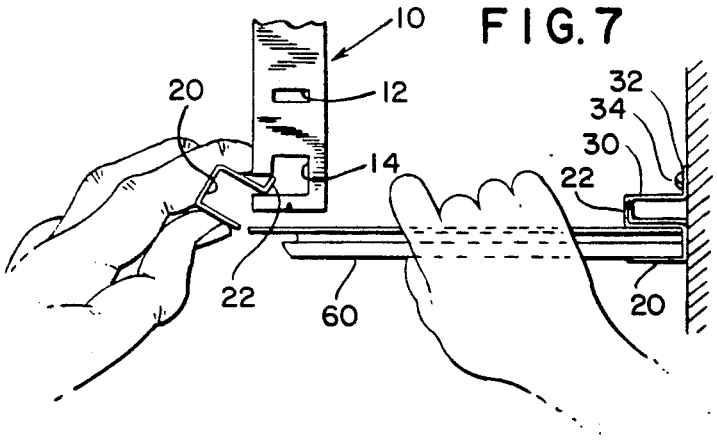
FIG. 7 is an elevation cross-sectional view of an embodiment of this invention.
Figure 6A:
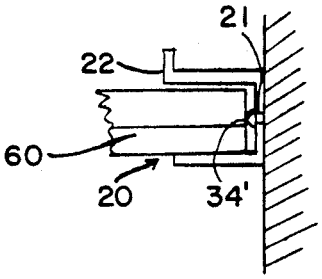
FIG. 6A is a cross-sectional view of an alternative means of affixing edge channels to their associated walls.
Figure 8:
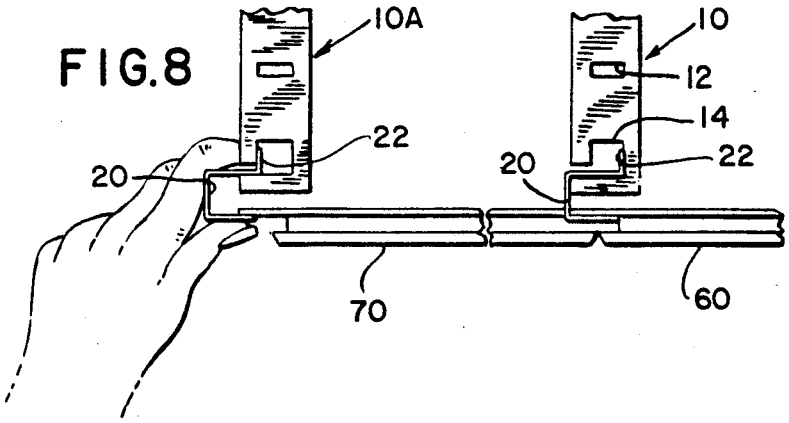
FIG. 8 is another elevation cross-sectional view of the embodiment of this invention shown in FIG. 7.

With the array of leveling hangers 10 so established, the border row 68 of tiles may be installed with its cut edge (or its tongue edge, if it is a full width, uncut ceiling tile) inserted into the channel 20 that was affixed to the starting wall, whether as shown in FIG. 6A, or in FIGS. 6 and 7. Channels 20 may then be positioned in the channel mount apertures 14 of those among the array of hangers 10 that form the first row parallel to the starting wall, with the lower legs of their respective U-shaped portions residing in the grooves in the sides of the border tiles 69. The lip 22 of each channel 20, which is wider than the height if the entry hole in the side of channel mount aperture, is oriented upward to lock each channel in place so that it cannot slide back out of its associated aperture 14. The positioning and dimensioning of the apertures 14 and the channels 20 vis-a-vis the lower end of the hangers 10 is to be noted. When the inside of the leg of the U of channel 20 that is adjacent the lip 22 is seated on the bottom of aperture 14 with the inside of the opposite leg of the U inserted into the edge groove of the ceiling tile 60, the bottom or finish surfaces of the tiles will be coplanar with respect to each other and to the bottom of the side wall channels. From the foregoing, it will be apparent why, although a wide variety of shapes for the aperture 14 is possible, it is preferred for it to be a "quadrate" which, as used throughout this Specification and the accompanying claims, means a square, or anything resembling a square in the broadest sense, including (without limitation) a rectangle or other configuration having straight sides and a floor. As will be apparent from FIGS. 6 and 8, with this channel so positioned, a second row of tiles 70 may be positioned with its edge tongue in the same groove of the tile 60 as is the leg of the channel 20. So positioned, the lower legs of the first row of channels 20 hanging from the hangers 10 are effectively concealed inside the interlocking tongue and groove surfaces of adjacent tiles. The effect of this is to provide hanger supports for the tile sequences that are "blind", or not visible from the underside of the finished tile ceiling. Following this, as shown in FIG. 8, another set of channels 10 may be positioned on the second row of hangers, and then a third, and so forth.

(6) Finishing the ceiling

The foregoing process is carried out row after row towards completion of the entire ceiling. Installation of the last border row, which is to be placed next to the finishing wall, is facilitated by removing an additional portion (for example, about $\frac{3}{8}$ inch) from the edge of the tiles that will reside next to the finishing wall. Any gap between the finishing wall and the last row of outer tiles is obscured by the lower flange of the channels that are affixed to the finishing wall. The result, at the end of the entire process, is to have produced a ceiling tile hanger system with tiles installed, in which the visible ceiling surface is substantially in the configuration of a flat plane. In that connection, the physical dimensions should be noted in a typical system, since it will illustrate relationships that are generally comparable and will produce similar results in comparable cases. Thus, in the embodiment described, the ceiling tiles employed may be $\frac{5}{8}''$ thick, and have edge grooves that are are $\frac{1}{4}''$ in width, thus leaving a $\frac{1}{8}''$ surface segment on the top side of each edge groove and a $\frac{1}{4}''$ segment on the bottom edge. The width of the U shaped channels may then be set at $\frac{5}{8}''$. If the distance from the floor of the hanger aperture to the bottom of the hanger is $\frac{1}{4}''$, the bottom leg of the side-facing U of the channel will extend $\frac{3}{8}''$ below the bottom of the hanger and the visible surface of a suspended tile will be 1" below that floor. Since the wall hanger hole is $\frac{1}{8}''$ above the outermost edge of the lip of a channel positioned in the wall hanger, and since that lip is $\frac{3}{8}''$ wide, the bottom leg of the channel will be $\frac{5}{8}''$ below the bottom of the wall clip and level with the bottom of channels held in the mid-span hangers.

From the foregoing it will be apparent that this invention makes it possible to install a hung ceiling quickly, easily and effectively, that will be level and substantially free at its visible surfaces from any evidence of its associated suspension structures. Further, unique installation methods are disclosed herein which embody this invention as well. Thus it is possible, through practice of this invention, to produce new and novel structures that overcome a variety of difficulties that have been experienced with prior art devices. Accordingly, it is to be understood that the embodiments described are by way of illustration and not of limitation, and that a wide variety of embodiments may be made without departing from the spirit or scope of this invention.

I claim:

1. A method of erecting a support system for a hung ceiling which includes ceiling tiles having edge slots and also includes a plurality of channel members, each of which has an elongated U-shaped receptacle that is dimensioned and configured to receive and retain the edge of ceiling tiles to be associated therewith, means for retentively affixing selected among said channel members to walls, each with its respective U-shaped receptacle substantially horizontal and facing outwards from the wall to which it is affixed, and a plurality of hanger means, each of which consists of an elongated hanger that has mounting means at one of its ends adapted to retain one of the remaining of said channels, and is adapted for fixation at the other of its ends to an overhead support with the U-shaped receptacle of the channel being retained by it facing toward that of one of said selected channels, comprising the steps of selecting a starting wall of the room in which said system is to be installed, selecting a finishing wall opposite said starting wall, marking with wall hanger position marks the desired level of the ceiling to be installed at sequential locations on the wall surfaces of said room, connecting sequential among said wall hanger position marks by means of straight lines around said room, affixing some of said channels to said walls at predetermined positions with respect to said lines, with their U shapes facing away from the wall on which each respectively is positioned, level strings from sequential locations along the channels on one side of said room to channels on the opposite side of said room, positioning said hangers at successive locations along each of said strings that are at the same distance from each location on either side as the dimension in that direction of the tiles to be installed in said ceiling, with the channel mounting means on each oriented downward and with the topmost end of said hanger juxtaposed to the surface to which said hanger is to be attached and with said channel mounting means so positioned that when such channels are mounted thereby on said hangers and ceiling tiles are retentively positioned thereon by means of their edge slots, the undersurfaces of said tiles are substantially coplanar with the undersurfaces of ceiling tiles positioned in said channels affixed to said walls, affixing each of said hangers to the surface to which it is to be attached, and positioning channels in said hangers with each such channel oriented in the direction of the same one from among all of the channels affixed to the walls of said room.

2. The method described in claim 1 including the additional steps of installing a first row of ceiling tiles along the length of and outward from channels affixed to one of said walls, with the channels retentively positioned in the channel hanger means forming the row next to said wall mounted channels having one leg of the U of each positioned in the edge slot of the tiles forming said first row of tiles, installing additional rows of ceiling tiles seriatim in sequential rows proceeding away from said first row of tiles, with the tongues of each residing in the edge grooves of the corresponding tiles in the row next previously completed, and with the lower leg of the U of each row of hangers positioned in the edge slots of installed tiles correspondingly positioned until the last such row necessary to complete said ceiling, and installing the last row of ceiling tiles with their tongues residing in the edge slots of the rows of tiles immediately next installed and with their opposite edges positioned in the channels retentively positioned on the wall opposite that at which the process was begun.

* * * * *

UNITED STATES PATENT AND TRADEMARK OFFICE

CERTIFICATE OF CORRECTION

PATENT NO. : 5,177,929

DATED : Jan 12, 1993

INVENTOR(S) : Henry B. Reynolds

It is certified that error appears in the above-indentified patent and that said Letters Patent is hereby corrected as shown below:

On the title page, after Item [22] insert the following: "Related U.S. Application Data Item [60] Division of Ser. No. 524,059, May 16, 1990, Pat. No. 5,081,812"

Column 1, line 4, insert the following: "This is a division of application Ser. No.524,059, now U.S. Pat. No. 5,081,812 issued Jan. 21, 1992, filed May 16, 1990.

Signed and Sealed this

Fourth Day of January, 1994

*Attest:*

*Attesting Officer*

Bruce Lehman

BRUCE LEHMAN

*Commissioner of Patents and Trademarks*